United States Patent [19]

Engelhard et al.

[11] Patent Number: 4,629,468

[45] Date of Patent: Dec. 16, 1986

[54] PROCESS FOR TREATING CELLULOSIC FIBRE MATERIAL

[75] Inventors: Helmut Engelhard, Dormagen; Dieter Feuser, Cologne; Udo Hendricks, Odenthal; Ergun Tamer, Leverkusen, all of Fed. Rep. of Germany

[73] Assignee: Bayer Aktiengesellschaft, Leverkusen, Fed. Rep. of Germany

[21] Appl. No.: 724,385

[22] Filed: Apr. 18, 1985

[30] Foreign Application Priority Data

May 5, 1984 [DE] Fed. Rep. of Germany ..... 3416693

[51] Int. Cl.[4] ..... D06P 5/02

[52] U.S. Cl. ..... 8/442; 8/188; 8/606; 8/120; 8/129; 252/8.9; 564/505; 564/462

[58] Field of Search ..... 8/188, 606, 115.5, 120, 8/129, 442

[56] References Cited

U.S. PATENT DOCUMENTS

| | | | |
|---|---|---|---|
| 2,096,534 | 10/1937 | Bayer et al. | 260/27 |
| 4,198,269 | 4/1980 | Evani et al. | 162/164 |

FOREIGN PATENT DOCUMENTS

| | | |
|---|---|---|
| 0057398 | 4/1981 | European Pat. Off. . |
| 2060572 | 12/1970 | Fed. Rep. of Germany . |
| 460961 | 2/1937 | United Kingdom . |
| 969159 | 9/1964 | United Kingdom . |
| 2084597 | 4/1982 | United Kingdom . |
| 2090877 | 6/1982 | United Kingdom . |

*Primary Examiner*—Paul Lieberman
*Assistant Examiner*—Brooks Truskett
*Attorney, Agent, or Firm*—Sprung Horn Kramer & Woods

[57] ABSTRACT

The treatment of cellulosic fibre materials before or after dyeing or printing with direct or reactive dyestuffs is carried out with aqueous liquors which contain quaternized polyethers which are obtained by condensation of N-2-hydroxyalkylamines of the formula

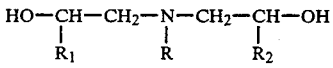

(I)

in which $R_1$ and $R_2$, independently of each other, denote hydrogen or a $C_1$–$C_4$-alkyl radical and R denotes a $C_1$–$C_{18}$-alkyl, cycloalkyl, aralkyl or aryl radical or one of the hydroxyalkyl groups

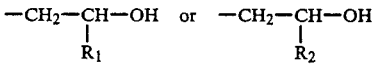

with the proviso that the amount of N-2-hydroxyalkylamines in which R stands for a hydroxyalkyl group accounts for no more than 20 percent by weight of the hydroxyalkylamines used, if desired by co-condensation with polyols of the formula

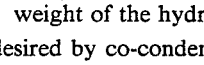

II in which

A denotes a 2-, 3- or 4-valent aliphatic, cycloaliphatic, araliphatic or aromatic radical and n is a number from 2 to 4, and subsequent quaternization.

20 Claims, No Drawings

PROCESS FOR TREATING CELLULOSIC FIBRE MATERIAL

The invention relates to a process for treating cellulosic fibre materials with aqueous liquors before or after dyeing or printing said materials with direct or reactive dyestuffs. The process is characterized in that before or after the dyeing or printing the fibre materials are treated with aqueous liquors which contain quaternised polyethers which are obtained by condensation of N-2-hydroxyalkylamines of the formula

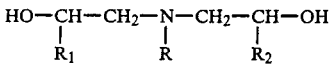

(I)

in which $R_2$ and $R_2$, independently of each other, denote hydrogen or a $C_1$–$C_4$-alkyl radical and R denotes a $C_1$–$C_{18}$-alkyl, cycloalkyl, aralkyl or aryl radical or one of the hydroxyalkyl groups

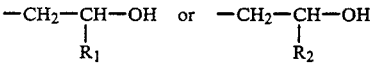

with the proviso that the amount of N-2-hydroxyalkylamines in which R stands for a hydroxyalkyl group accounts for no more than 20 percent by weight of the hydroxyalkylamines used, if desired by co-condensation with polyols of the formula $$A(OH)_n \qquad \text{II}$$

in which

A denotes a 2-, 3- or 4-valent aliphatic, cycloaliphatic, araliphatic or aromatic radical and n is a number from 2 to 4, and subsequent quaternisation.

Examples of R are:

as $C_1$–$C_{18}$-alkyl radicals the methyl, ethyl, propyl, n-butyl, sec.-butyl, 2-ethylhexyl, decyl, dodecyl or stearyl radical;

as cycloalkyl radicals in particular the cyclohexyl radical and $C_1$–$C_4$-alkyl-substituted cyclohexyl radicals, such as the methylcyclohexyl, ethylcyclohexyl, butylcyclohexyl, dimethylcyclohexyl and diethylcyclohexyl radical;

as aralkyl radicals in particular the optionally $C_1$–$C_4$-alkyl-substituted benzyl radical; and as aryl radicals in particular the optionally $C_1$–$C_4$-alkyl-substituted phenyl radical, such as the cresyl, xylyl, ethylphenyl and tert.-butylphenyl radical.

As $C_1$–$C_4$-alkyl radicals $R_1$ and $R_2$ can be for example methyl, ethyl, n-propyl, iso-propyl, n-butyl or sec.-butyl radicals.

In preferred compounds (I), R stands for $C_1$–$C_4$-alkyl or cyclohexyl and $R_1$ and $R_2$ stand for hydrogen or methyl.

The aliphatic radicals A can be interrupted by heteroatoms and additionally by aromatic radicals. Noteworthy are in particular $C_2$–$C_4$-alkylene radicals or radicals of the formulae $-(C_xH_{2x}-O-)_yC_xH_{2x}-$ and -continued

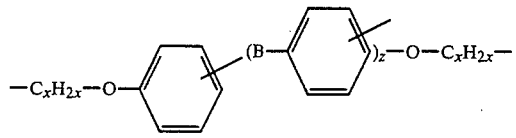

wherein

B stands for O, S, CO or $C_yH_{2y}$, x stands for 2 or 3, y stands for 1–3 and z stands for 0 or 1.

Preferred cycloaliphatic, araliphatic and aromatic radicals A are derived from cyclohexylene, xylylene and phenylene. The polyols can be: aliphatic polyols, for example diols, such as ethylene glycol, propylene glycol, butylene glycol, diethylene glycol, triethylene glycol or tetraethylene glycol, triols, such as glycerol, trimethylolethane or trimethylolpropane, tetraols, such as pentaerythritol, 1,4-di-β-hydroxyethoxybenzene, 4,4'-di-β-hydroxyethoxydiphenyl ether, 4,4'-di-β-hydroxyethoxydiphenyl sulphide, 4,4'-di-β-hydroxybenzophenone, 2,2-bis-(4-β-hydroxyethoxyphenyl)-propane, and cycloaliphatic diols, such as 1,4-bis-methylolbenzene.

It has been found to be advantageous for the amount of co-condensed polyols to be no higher than 25 percent by weight, relative to the weight of the polyether.

The average molecular weight of the polyethers to be used according to the invention should be between 500 and 20,000, preferably 1,000 to 15,000.

The polyethers to be used according to the invention are linear or have a low degree of branching. The linear polyethers can be obtained by known methods by condensing N-2-hydroxyalkylamines of the formula I at elevated temperatures, for exaple 150°–280° C., in the presence of acid catalysts, for example $H_3PO_3$. To obtain branched polyethers, diols containing tertiary amino groups are condensed together with triols containing tertiary amino groups, i.e. N-2-hydroxyalkylamines of the formula I in which R stands for one of the specified β-hydroxyalkyl groups. To avoid any cross-linking, however, the level of triols in the condensation mixture should be no higher than 20 percent by weight, preferably 2–15 percent by weight.

The polyethers to be used according to the invention are known for example from No. GB-A-1,107,818 and No. DE-A-2,060,572.

Examples of β-hydroxyalkylamines of the formula (I) are the N-di-(2-hydroxyalkyl)-amines as formed on addition of ethylene oxide, propylene oxide and butylene oxide or mixtures of these alkylene oxides onto primary aliphatic, cycloaliphatic, araliphatic and aromatic amines.

Examples of representatives of these N-di-(2-hydroxyalkyl)-amines (I) are: N,N-bis-(2-hydroxyethyl)-N-methylamine, N,N-bis-[2-hydroxyprop-1-yl]-methylamine, N,N-bis-[2-hydropybut-1-yl]-methylamine, N,N-bis-(2-hydroxyethyl)-N-isopropylamine, N,N-bis-(2-hydroxyethyl)-N-n-butylamine, N,N-bis-(2-hydroxyethyl)-cyclohexylamine, N,N-bis-(2-hydroxyethyl)-N-benzylamine, N,N-bis-(2-hydroxyethyl)-N-(4-methylbenzyl)-amine, N,N-bis-(2-hydroxyethyl)-aniline, N,N-bis-[2-hydroxyprop-1-yl]-aniline, N,N-bis-(2-hydroxyethyl)-3-methylaniline and N,N-bis-(2-hydroxyethyl)-4-tert.-butylaniline.

Representatives of the triols co-used in preparing the branched polyethers are, for example, in particular triethanolamine, triisopropanolamine and tributanolamine.

The quaternisation is conducted in a manner known per se, by reacting the polyethers, which may be dissolved or suspended in alcohol-water mixtures, with known alkylating agents, such as dimethyl sulphate or diethyl sulphate, alkyl p-toluenesulphonates, for example methyl p-toluenesulphonate, alkyl halides, for example methyl iodide or ethyl bromide, chloroacetamide, salts of halogenocarboxylic acids, esters of halogenocarboxylic acids, alkane sultones, benzyl chloride, dimethyl methanephosphonate, trimethyl phosphate or alkylene oxide, such as ethylene oxide and propylene oxide, in the presence of acids.

It is not necessary in this case to quaternise the basic polyethers completely, since it is possible to obtain highly effective compounds if only a proportion of the basic nitrogen atoms of the polyether are quaternised.

The amounts in which the quaternised polyethers to be used according to the invention are added to the aqueous liquors can vary within wide limits. In general, it has been found to be suitable to add 0.1–2%, preferably 0.2–1%, on weight of fibre.

The quaternised polyethers can be applied in a pretreatment process to the untreated fibre material to be dyed or printed to improve the colour yield by impregnating or printing with aqueous liquors which contain the quaternised polyethers. The fibre material thus treated is squeezed off, for example down to a liquor pick-up of 60–100%, is dried and, if desired after a heat treatment, for example by flash ageing at 102°–120°, is dyed or printed in conventional manner.

The aftertreatment of the dyed or printed fibre material to improve the wet fastness is either carried out as an exhaust method, by introducing the dyed or printed material for, for example, 20–30 minutes into an aqueous liquor which contains the quaternised polyethers to be used according to the invention and has a pH of, for example, 4–8, preferably 5.5–6.5, and a temperature of 20°–40° C., or the liquor serving for the aftertreatment is applied to the dyed or printed material continuously, for example by means of a pad-mangle.

Suitable dyestuffs for preparing the dyeings and prints are listed for example in the Colour Index, 3rd edition (1971), Volume 2 on pages 2005–2478 as direct dyes and on pages 1001–1562 as acid dyes. Suitable reactive dyestuffs are described for example in Venkataraman, The Chemistry of Synthetic Dyes, Volume VI, Reactive Dyes (Academic Press, New York, London 1972).

According to the invention, suitable fibre materials are especially those made of natural or regenerated cellulose; there may be mentioned cotton, hemp, jute, linen as well as viscose and cellulose acetate fibres and blend fabrics containing cellulose fibres.

The fibre material can be in various states of processing and be present as, for example, loose material, yarn or woven or knitted fabric.

The process according to the invention has the effect of appreciably improving the colour yield and the fastness properties of dyeings and prints, in particular the perspiration, water and wash fastness properties.

Compared with the condensation products of ammonium salts, cyanamide derivatives and formaldehyde which are frequently used for improving the wet fastness properties and which are of the type described for example in U.S. Pat. No. 3,290,310 or in Rev. Prog. Coloration Vol. 12 (1982), pages 76–77, the compounds according to the invention have the advantage of the complete absence of formaldehyde.

A further advantage of the claimed compounds is the low impairment of the handle of the treated fibre materials and the light fastness of the dyeings. Moreover, they do not affect the hue of the dyeings. Preparation of the polyethers used in the examples:

Polyether A

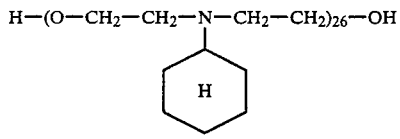

1,500 parts of di-β-hydroxyethylcyclohexylamine were condensed at 220°–230° C. under nitrogen in the presence of 15 parts of $H_3PO_3$ for 3 hours. The reaction mixture was then heated at 220° C. under reduced pressure (12 mm Hg) for 1 hour to remove the volatile constituents. The polyether obtained as the residue is a yellow water-insoluble syrup (average molecular weight: 4,460; OH number: 25).

150 parts of this polyether were dissolved in 200 parts by volume of methanol, and 82 parts of dimethyl sulphate (0.75 mole of dimethyl sulphate per mole of basic amino group) were added at the boil. The reaction mixture was refluxed for 3 hours. This solvent was then distilled off in vacuo. The quaternisation product remains behind as a yellow water-insoluble syrup.

Polyether B

Polyether B was prepared analogously to polyether A, except that the 82 parts of dimethyl sulphate used in the quaternisation was cut back to only 54 parts of dimethyl sulphate (0.5 mole of dimethyl sulphate per mole of basic amino group). The quaternisation product remains behind as a yellow water-soluble syrup.

Polyether C

Polyether C was prepared analogously to polyether A, except that the 82 parts of dimethyl sulphate used in the quaternisation was increased to 108 parts of dimethyl sulphate (1.0 mole of dimethyl sulphate per mole of basic amino group). The quaternisation product remains behind as a yellow water-soluble syrup.

Polyether D

Starting material:

First, 500 parts of N,N-di-(β-hydroxyethyl)-N-cyclohexylamine were condensed in the presence of 7.5 parts of $H_3PO_3$ analogously to the preparation of polyether A to give a polyether having an OH number of 8.6, which corresponds to an average molecular weight of 13,000. The polyether can be described by the formula

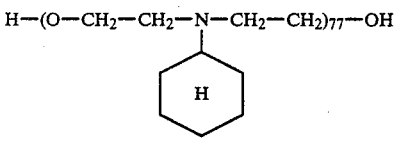

85 parts of this polyether were suspended in 80 parts by volume of methanol, and 19 parts of dimethyl sulphate (0.3 mole of dimethyl sulphate per mole of basic amino group) were added at the boil. After two hours of refluxing the solvent was distilled off. The quaternised polyether was obtained in the form of a yellow water-soluble syrup.

Polyether E

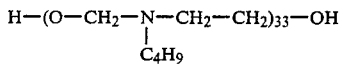

1,900 parts of N,N-di-(β-hydroxyethyl)-N-butylamine were condensed at 200° C. under nitrogen in the presence of 19 parts of $H_3PO_3$ for 9 hours. The reaction mixture was then heated at 200° C. under reduced pressure (12 mmHg) for 2 hours to remove the volatile constituents. The polyether obtained as residue is a water-insoluble, slightly reddish viscous oil (average molecular weight: 5,000; OH number: 22).

190 parts of the polyether obtained were dissolved in 150 parts of isopropanol, and 166 parts of dimethyl sulphate (1.0 mole of dimethyl sulphate per mole of basic amino group) were added at 60°-70° C. After refluxing for two hours the solvent was distilled off. The quaternised polyether was obtained in the form of a highly viscous water-soluble syrup.

Polyether F

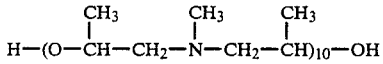

700 parts of N,N-di-(β-hydroxypropyl)-N-methylamine were condensed at 220° C. under nitrogen in the presence of 10.5 parts of $H_3PO_3$. The reaction mixture was then heated at 220° C. under reduced pressure (12 mm Hg) for 1 hour to remove the volatile constituents. The polyether obtained as residue is a water-soluble, slightly reddish viscous oil (average molecular weights: 1,340; OH number: 84). 150 parts of the polyether obtained were dissolved in 100 parts of isopropanol, and 144 parts of dimethyl sulphate (1.0 mole of dimethyl sulphate per mole of basic amino group) were added at 60°-70° C. After refluxing for two hours the solvent was distilled off. The quaternised polyether was obtained in the form of a highly viscous water-soluble syrup.

Polyether G

Starting material:

First, 500 parts of N,N-di-(β-hydroxyethyl)-N-cyclohexylamine were condensed in the presence of 7.5 parts of $H_3PO_3$ analogously to the preparation of polyether A to give a polyether having an OH number of 14 which corresponds to an average molecular weight of 8,000. The polyether can be described by the formula

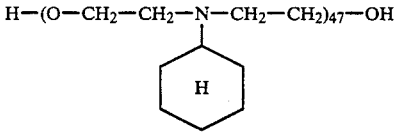

338 parts of this polyether were dissolved in 400 parts by volume of methanol, and 173 parts of methyl chloroacetate (0.8 mole of chloroacetate per mole of basic amino group) were added at the boil. After refluxing for 3 hours the solvent was distilled off in vacuo. The quaternisation product was obtained in the form of a water-soluble yellow oil.

Polyether H

Starting material:

1,800 parts of N,N-di-(β-hydroxyethyl)-N-cyclohexylamine and 200 parts of 2,2-di-[(β-hydroxyethoxy)-phenyl]-propane were condensed at 220°-230° C. under nitrogen in the presence of 20 parts of $H_3PO_3$ for 5 hours. The reaction mixture was then heated at 220° C. under reduced pressure (12 mm Hg) for 1 hour to remove the volatile constituents. The polyether obtained as the residue is a yellow syrup (average molecular weight: 8,000; OH number: 14; basic amino group content: 5.16 equivalent/kg of polyether).

300 parts of the polyether were dissolved in 300 parts by volume of methanol, and 158 parts of dimethyl sulphate (0.8 mole of dimethyl sulphate per mole of basic amino group) were added dropwise at the boil. The reaction mixture was refluxed for 2 hours. The solvent was then distilled off in vacuo. The quaternisation product remains behind as a slightly yellowish water-soluble syrup.

Polyether I Starting material No. 1:

1,385 parts of N,N-di-(β-hydroxypropyl)-N-methylamine were condensed at 210°-220° C. under nitrogen in the presence of 62 parts of $H_3PO_3$ for 5 hours. The reaction mixture was then heated at 210° C. under reduced pressure (12 mm Hg) for 1 hour to remove the volatile constituents. The polyether obtained as residue is a slightly reddish viscous water-soluble oil (average molecular weight: 1,280; OH number: 86; basic amino group content: 7 equivalents/kg of polyether).

The polyether can be described by the formula

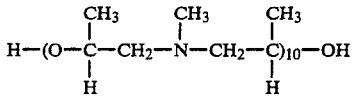

Starting material 2:

710 parts of this polyether and 710 parts of N,N-di-(β-hydroxyethyl)-N-cyclohexylamine were condensed at 220° C. under nitrogen in the presence of 15 parts of $H_3PO_3$ for 10 hours. The reaction mixture was then heated at 220° C. under reduced pressure (12 mm Hg) for 3 hours to remove the volatile constituents. The copolyether obtained as residue is a water-insoluble, orange-coloured syrup (average molecule weight: 6,150; OH number: 18; basic amino group content: 6.8 equivalents/kg of polyether).

500 parts of the copolyether were dissolved in 500 parts by volume of methanol, and 128 parts of dimethyl sulphate (0.3 mole of dimethyl sulphate per mole of amino group) were added dropwise at the boil. The reaction mixture was refluxed for 6 hours. The solvent was then distilled off in vacuo. The quaternisation product remains behind as a water-soluble yellow syrup.

Polyether K

Starting material:

360 parts of N,N-di-(β-hydroxyethyl)-N-cyclohexylamine and 40 parts of triethanolamine were condensed at 220° C. under nitrogen in the presence of 1.5 parts of $H_3PO_3$ for 5 hours. The reaction mixture was then heated at 170° C. under reduced pressure (12 mm Hg) for 1 hour to remove the volatile constituents. The branched copolyether obtained as residue is a slightly yellowish water-insoluble syrup (OH number: 108; basic amino group content: 6.3 equivalents/kg of polyether).

200 parts of the polyether were suspended in 300 parts by volume of methanol, and 79 parts of dimethyl sulphate (0.5 mole of dimethyl sulphate per mole of amino group) were added at the boil. After refluxing for 3 hours the solvent was distilled off in vacuo. The quaternised polyether was obtained in the form of a water-soluble syrup.

EXAMPLE 1

A cotton fabric is treated at 40° C. on a winch beck in a liquor ratio of 20:1 with a dyeing liquor which contains per liter 1 g of the dyestuff Direct Red 79 (C.I. 29,065). The dyebath was raised to 98° C. in the course of 30 minutes, 10 g/l of calcined sodium sulphate is then added, and dyeing is carried out at the same temperature for one hour. When the dyebath has cooled down to 80° C., the dyeing is rinsed in cold water. The dyeing is then treated at 30° C. in a fresh bath which contains per liter 0.5 g of polyether A and 0.2 g of 60% strength acetic acid for 30 minutes and is then rinsed with cold water and dried. Fastness tests carried out on this aftertreated dyeing show that the wet fastness level has been significantly improved by the aftertreatment.

EXAMPLE 2

A cotton fabric is dyed, rinsed and dried, all three steps being carried out as described in Example 1. The dyeing is then treated at room temperature on a padmangle with a liquor which contains per liter 15 g of polyether C and 0.5 g of 60% strength acetic acid, is squeezed off to a liquor pick-up of 100%, and is dried. This aftertreatment has the effect, similar to that in Example 1, of significantly improving the wet fastness level.

EXAMPLE 3

A cotton fabric is treated at 25° C. on a winch beck in a liquor ratio of 20:1 with a dyeing liquor which contains per liter 2 g of the red dyestuff of No. DE-A-2,264,698 (Example 3). The dyebath is raised to 40° C. in the course of 30 minutes, 50 g/l of sodium sulphate are added, followed after a further 10 minutes by 20 g/l of sodium carbonate, and the dyeing is carried out at 40° C. for 1 hour. The dyeing is then rinsed with cold, hot and boiling water. The dyeing is then treated with polyether A in a fresh bath as described in Example 1.

Fastness tests carried out on this aftertreatment dyeing show that the wet fastness level has been significantly improved by the aftertreatment.

EXAMPLE 4

A cotton fabric is dyed, rinsed, soaped off and dried, all four steps being carried out as described in Example 3.

The dyeing is then aftertreated as described in Example 2. The aftertreatment has the effect, similar to that in Example 3, of significantly improving the wet fastness level.

EXAMPLE 5

A cotton fabric is printed with an aqueous preparation which contains per liter 60 g of polyether D and 500 g of a 4% strength aqueous solution of a non-ionic thickener and is then dried.

The material thus pretreated is then dyed and rinsed, both steps being carried out as described in Example 1. The printed area are in a markedly deeper depth of shade than the unprinted areas.

We claim:

1. A process for treating cellulose textile before dyeing or printing said textile with direct or reactive dyestuffs to improve color yield comprising impregnating or printing said textile with an aqueous liquor containing 0.1–2% by weight of the textile of quaternized polyethers obtained by self condensation of N-2-hydroxyalkylamines of the formula

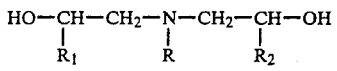

in which $R_1$ and $R_2$, independently of each other, denote hydrogen or a $C_1$–$C_4$-alkyl radical and R denotes a $C_1$–$C_{18}$-alkyl, cycloalkyl, aralkyl or aryl radical or one of the hydroxyalkyl groups

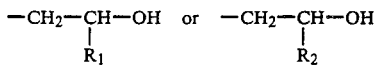

with the proviso that the amount of N-2-hydroxyalkylamines in which R stands for a hydroxyalkyl group accounts for no more than 20 percent by weight of the hydroxyalkylamines used, and subsequent quaternization.

2. Process according to claim 1, wherein the polyethers have a molecular weight of 500–20,000.

3. Process according to claim 1, wherein the polyethers are prepared from N-2-hydroxyalkylamines wherein R stands for $C_1$–$C_4$-alkyl or cyclohexyl and $R_1$ and $R_2$ stand for hydrogen or methyl.

4. A process according to claim 1, wherein the condensation is carried out at 150°–280° C. in the presence of acid catalyst.

5. A process for treating cellulose textile before dyeing or printing said textile with direct or reactive dyestuffs to improve color yield comprising impregnating or printing said textile with an aqueous liquor containing 0.1–2% by weight of the textile quaternized polyethers obtained by condensation of N-2-hydroxyalkylamines of the formula

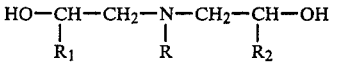

in which $R_1$ and $R_2$, independently of each other, denote hydrogen or a $C_1$–$C_4$-alkyl radical and R denotes a $C_1$–$C_{18}$-alkyl, cycloalkyl, aralkyl or aryl radical or one of the hydroxyalkyl groups $$-CH_2-\underset{\underset{R_1}{|}}{CH}-OH \quad \text{or} \quad -CH_2-\underset{\underset{R_2}{|}}{CH}-OH$$

with the proviso that the amount of N-2-hydroxyalkylamines in which R stands for a hydroxyalkyl group accounts for no more than 20 percent by weight of the hydroxyalkylamines used with a positive amount of up to 25% by weight of polyols for the formula $$A(OH)_n$$

in which

A denotes a 2-, 3- or 4-valent aliphatic, cycloaliphatic, araliphatic or aromatic radical and n is a number from 2 to 4, and subsequent quaternization.

6. Process according to claim 5, wherein the polyethers have a molecular weight of 500–20,000.

7. Process according to claim 5, wherein the polyethers are prepared from N-2-hydroxyalkylamines where R stands for $C_1$–$C_4$-alkyl or cyclohexyl and $R_1$ and $R_2$ stand for hydrogen or methyl.

8. A process according to claim 5, wherein the condensation is carried out at 150°–280° C. in the presence of acid catalyst.

9. Process for treating textile after dyeing or printing said textile in order to improve wet fastness comprising introducing said dyed or printed textile into an aqueous liquor containing 0.1–2% by weight of the textile of a polyether obtained by self condensation of N-2-hydroxyalkylamines of the formula $$HO-\underset{\underset{R_1}{|}}{CH}-CH_2-\underset{\underset{R}{|}}{N}-CH_2-\underset{\underset{R_2}{|}}{CH}-OH$$

in which $R_1$ and $R_2$, independently of each other, denote hydrogen or a $C_1$–$C_4$-alkyl radical and R denotes a $C_1$–$C_{18}$-alkyl, cycloalkyl, aralkyl or aryl radical or one of the hydroxyalkyl groups $$-CH_2-\underset{\underset{R_1}{|}}{CH}-OH \quad \text{or} \quad -CH_2-\underset{\underset{R_2}{|}}{CH}-OH$$

with the proviso that the amount of N-2-hydroxyalkylamines in which R stands for a hydroxyalkyl group accounts for no more than 20 percent by weight of the hydroxyalkylamines used, and subsequent quaternization.

10. Process according to claim 9, wherein the textile is treated with the aqueous liquors by the exhaust method after the dyeing or printing.

11. Process according to claim 9, wherein the textile is treated with the aqueous liquors in a continuous process after the dyeing or printing.

12. Process according to claim 9, wherein the polyethers have a molecular weight of 500–20,000.

13. Process according to claim 9, wherein the polyethers are prepared from N-2-hydroxyalkyl amines wherein R stands for $C_1$–$C_4$-alkyl or cyclohexyl and $R_1$ and $R_2$ stand for hydrogen and methyl.

14. A process according to claim 9, wherein the condensation is carried out at 150°–280° C. in the presence of acid catalyst.

15. Process for treating textile after dyeing or printing said textile in order to improve wet fastness comprising introducing said dyed or printed textile into an aqueous liquor containing 0.1–2% by weight of the textile of a polyether obtained by condensation of N-2-hydroxyalkylamines of the formula $$HO-\underset{\underset{R_1}{|}}{CH}-CH_2-\underset{\underset{R}{|}}{N}-CH_2-\underset{\underset{R_2}{|}}{CH}-OH$$

in which $R_1$ and $R_2$, independently of each other, denote hydrogen or a $C_1$–$C_4$-alkyl radical and R denotes a $C_1$–$C_{18}$-alkyl, cycloalkyl, aralkyl or aryl radical or one of the hydroxyalkyl groups $$-CH_2-\underset{\underset{R_1}{|}}{CH}-OH \quad \text{or} \quad -CH_2-\underset{\underset{R_2}{|}}{CH}-OH$$

with the proviso that the amount of N-2-hydroxyalkylamines in which R stands for a hydroxyalkyl group accounts for no more than 20 percent by weight of the hydroxyalkylamines used with a positive amount of up to 25% of polyols for the formula $$A(OH)_n$$

in which A denotes a 2-, 3- or 4-valent aliphatic, cycloaliphatic, araliphatic or aromatic radical and n is a number from 2 to 4, and subsequent quaternization.

16. Process according to claim 15, wherein the polyethers have a molecular weight of 500–20,000.

17. Process according to claim 15, wherein the polyethers are prepared from N-2-hydroxyalkyl amines wherein R stands for $C_1$–$C_4$-alkyl or cyclohexyl and $R_1$ and $R_2$ stand for hydrogen and methyl.

18. Process according to claim 15, wherein the textile is treated with the aqueous liquors by the exhaust method after the dyeing or printing.

19. Process according to claim 15, wherein the textile is treated with the aqueous liquors in a continuous process after the dyeing or printing.

20. A process according to claim 15, wherein the condensation is carried out at 150°–280° C. in the presence of acid catalyst.

* * * * *